United States Patent [19]

Fabrig

[11] 4,157,821

[45] Jun. 12, 1979

[54] METHOD AND APPARATUS FOR MANIPULATING MARGINALLY PERFORATED NOTE BOOKS PRIOR TO INTRODUCTION OF SPIRALS

[75] Inventor: Paul Fabrig, Neuffen, Fed. Rep. of Germany

[73] Assignee: WOMAKO-Maschinenkonstruktionen GmbH, Nürtingen, Fed. Rep. of Germany

[21] Appl. No.: 854,835

[22] Filed: Nov. 25, 1977

[30] Foreign Application Priority Data

Nov. 26, 1976 [DE] Fed. Rep. of Germany ..... 2653759
Jul. 27, 1977 [DE] Fed. Rep. of Germany ..... 2733820

[51] Int. Cl.[2] ..... B42B 2/00
[52] U.S. Cl. ..... 270/53; 11/1 A
[58] Field of Search ..... 270/52, 53, 58; 11/1 A; 281/21 A; 271/232

[56] References Cited

U.S. PATENT DOCUMENTS 2,273,824 2/1942 Barrett ..... 11/1 A

FOREIGN PATENT DOCUMENTS 563420 5/1957 Italy ..... 11/1 A

*Primary Examiner*—Edgar S. Burr
*Assistant Examiner*—A. Heinz
*Attorney, Agent, or Firm*—Peter K. Kontler

[57] ABSTRACT

Note books having marginal holes consisting of registering perforations in the sheets of the note books are manipulated prior to insertion of metallic or plastic spirals, which are to be transformed into binders that hold the note book sheets together, so as to convert each hole into an arcuate passage having a radius of curvature which matches or approximates the radius of the spiral. The conversion takes place in two successive stages at two discrete aligning stations adjacent to the path of holders which are supported by an indexible turret and each of which grips one or more note books. At the first aligning station, each hole receives the tips of two mandrels which are introduced from the opposite sides of the note book and are thereupon pivoted so that the respective hole is converted into a V-shaped passage. At the second station, a comb introduces its arcuate prongs into the adjacent V-shaped passages and the sheets are thereupon shifted relative to the inserted prongs so that the V-shaped passages are converted into arcuate passages having a curvature which matches the curvature of the prongs. The curvature of the prongs, in turn, matches the curvature of the convolutions of a spiral.

9 Claims, 18 Drawing Figures

1
3
4
6
6a
6b
7
8
8a
9
11
12
13
14
16
17
18
19
21
22
23
24
X
Y 36
96
77
79
94a
78
94b
92A
92B
91
92a
92b
93A
39
39
38
29
37
101
97
100
124
95
102
121
99
39
29
93
122
125
98
38
29
39
32

METHOD AND APPARATUS FOR MANIPULATING MARGINALLY PERFORATED NOTE BOOKS PRIOR TO INTRODUCTION OF SPIRALS

CROSS-REFERENCE TO RELATED APPLICATION

The method and arrangement of the present invention are disclosed in the commonly owned copending application Ser. No. 854,818 filed Nov. 25, 1977 for "Method and apparatus for making spiral binder note books".

BACKGROUND OF THE INVENTION

The present invention relates to a method and apparatus for making note books or pads whose leaves or sheets have marginal perforations for reception of spiral binders which hold the leaves together. More particularly, the invention relates to a method and arrangement for manipulating marginally perforated note books or pads prior to insertion of metallic or plastic spirals which are thereupon transformed into helical binders.

In presently known apparatus for the production of spiral binder note books or pads, the holes consisting of registering perforations in the leaves or sheets are converted into arcuate passages for convenient introduction of the leader of a spiral by shifting the leaves relative to each other so that each originally straight hole assumes an arcuate shape. To this end, a profiling device is caused to move against the rear edge face of a note book and to thereby effect an appropriate displacement of neighboring sheets relative to each other. That surface of the profiling device which engages the rear edge face of the note book has a curvature matching the curvature of the convolutions of a metallic spiral which is thereupn threaded through the perforations of the sheets. A drawback of such arrangement is that predictable shifting of sheets which form a pad is insured only when the note books are relatively thin and/or when the size of the sheets is small.

It is also known to employ the profiling device in combination with arcuate prongs which are introduced into the holes of a note book prior to engagement of the rear edge face of the note book with the profiling device. The curvature of the prongs equals or approximates that of the convolutions of a spiral. Since the prongs are introduced into straight holes, the sheets must be formed with large-diameter perforations, especially if the diameter of the spiral is relatively small. Such apparatus, too, fail to insure that the leader of a spiral will invariably find its way during threading through the perforations of a pile of sheets which form a note book.

OBJECTS AND SUMMARY OF THE INVENTION

An object of the invention is to provide a novel and improved method of changing the configuration of holes which consist of registering perforations provided in one marginal portion of each sheet of a pile which my constitute one or more discrete note books or pads and is about to receive a spiral having a predetermined radius.

Another object of the invention is to provide a method which renders it possible to predictably change the configuration of marginal holes in piles of overlapping paper sheets or the like regardless of the number of sheets and/or the thickness of the pile.

A further object of the invention is to provide a method which can be resorted to for rapid and predictable displacement of sheets in a pile which constitutes one or more note books or pads.

An additional object of the invention is to provide a method whose reliability is not dependent on the size of sheets, i.e., on the length of the row of holes in the pile, and which can be resorted to for predictable shaping of holes regardless of the diameters of perforations of which the holes consist.

Still another object of the invention is to provide a novel and improved arrangement for the practice of the above outlined method.

Another object of the invention is to provide the arrangement with novel and improved aligning units which can be utilized to insure predictable conversion of normally straight holes into passages whose configuration is best suited to insure unimpeded insertion of the leader of a spiral.

An ancillary object of the invention is to provide an aligning unit which can effect a desirable coarse conversion of straight holes into passages whose configuration resembles the optimum configuration.

One feature of the invention resides in the provision of a method of changing the configuration of holes consisting of registering perforations which are provided in one marginal portion of each sheet of a pile of sheets which is about to receive a spiral having a predetermined radius and serving to hold the sheets of the pile together. The method comprises the steps of simultaneously converting all holes of the pile into substantially V-shaped passages, and thereupon simultaneously converting all V-shaped passages into arcuate passages having radii of curvature which at least approximate the predetermined radius.

The first mentioned converting step preferably includes introducing into each hole a pair of mandrels from opposite sides of the pile and pivoting at least one mandrel of each pair with respect to the other mandrel of the respective pair.

The last mentioned converting step may comprise inserting arcuate prongs into the V-shaped passages of the pile and effecting a relative movement between the sheets of the pile and the inserted prongs so that all sheets abut against the prongs. The radii of curvature of the prongs match or closely approximate the radius of the spiral.

Each sheet of the pile may be a composite sheet consisting of at least two immediately adjacent leaves, i.e., the pile may constitute a group of two or more immediately adjacent registering note books or pads.

The novel features which are considered as characteristic of the invention are set forth in particular in the appended claims. The improved arrangement itself, however, both as to its construction and its mode of operation, together with additional features and advantages thereof, will be best understood upon perusal of the following detailed description of an apparatus which embodies the arrangement and serves to convert sheets and spirals into spiral binder note books.

DESCRIPTION OF THE PREFERRED EMBODIMENTS

Figures 1A, 2A:
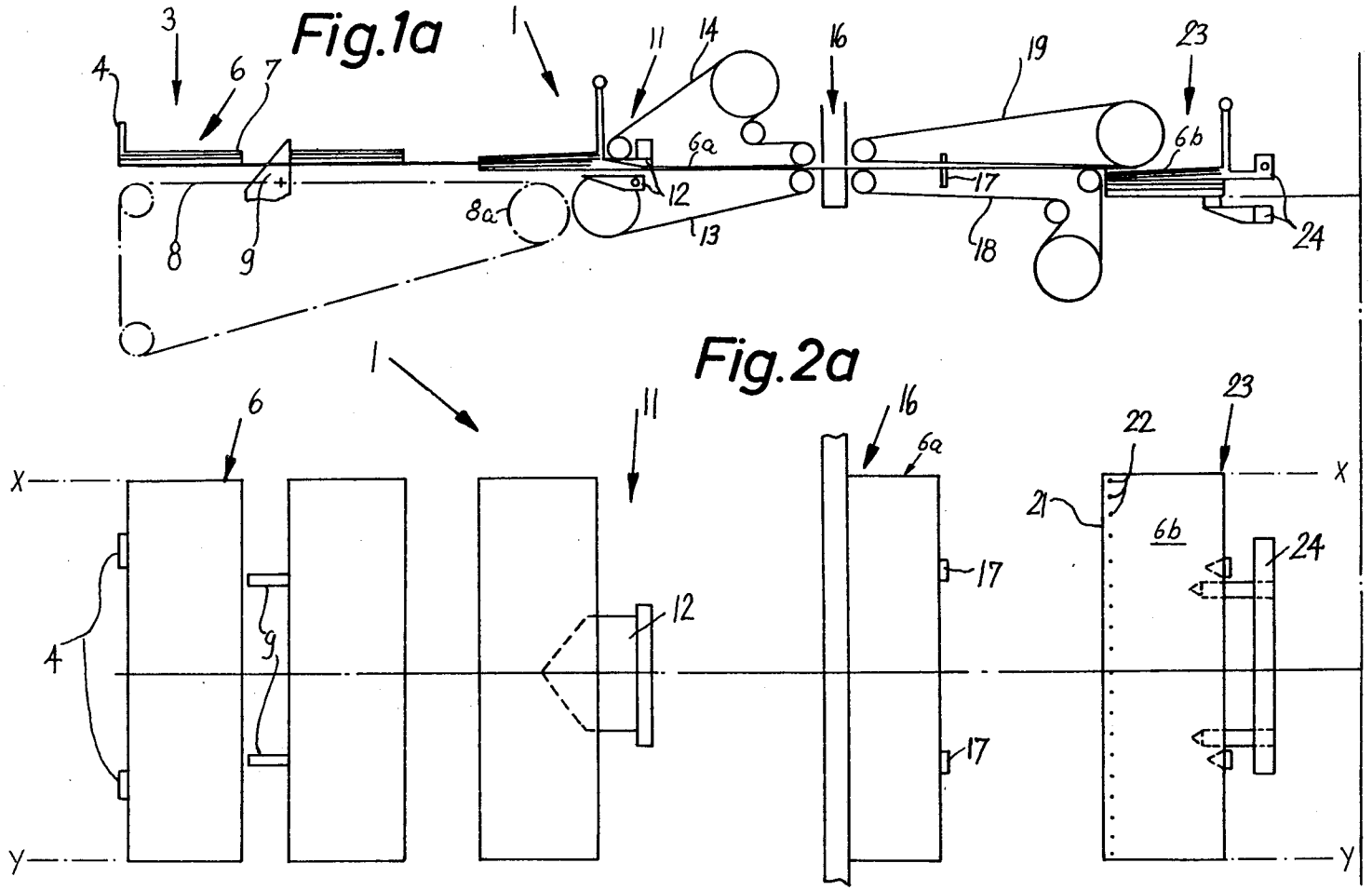
FIG. 1*a* is a schematic side elevational view of a first portion of an apparatus including an arrangement which embodies one form of the invention.
FIG. 2*a* is a schematic plan view of the structure shown in FIG. 1*a;*

Referring first to FIGS. 1*a,* 1*b,* 2*a* and 2*b,* the apparatus which is shown therein comprises an elongated straight first transporting and processing section 1 and an arcuate second transporting and processing section 2 which is located behind the section 1, as considered in the direction of transport of processed material.

The first section 1 includes a feeding or stack assembling station 3 wherein elongated sheets 7 of paper or the like are placed by hand against a locating stop 4 so that the sheets 7 form a stack 6. The length of the sheets 7 (as considered at right angles to the plane of FIG. 1*a*) is several (e.g., four) times the width of a note book or pad 29 (see FIGS. 2*b* and 9). The sheets 7 are placed against the locating stop 4 during the intervals of idleness of an intermittently operated endless sheet transporting belt conveyor 8 having one or more entraining elements 9 which can bypass the two-piece stop 4 (see FIG. 2*a*) to advance a freshly formed stack 6 in a direction to the right, as viewed in FIG. 1*a* or 2*a*. The means for intermittently driving the conveyor 8 is of conventional design and is not shown in the drawing. Such driving means can transmit torque to the shaft of one of the pulleys 8*a* for the conveyor 8.

The entraining element 9 transports successive stacks 6 to a subdividing unit 11 which breaks up each stack 6 into a series of smaller stacks 6*a* (e.g., into two stacks of equal height). To this end, the subdividing unit 11 comprises a blade-like proportioning device or tongs 12 which extends into the path of movement of the front side of an oncoming stack 6. Successive smaller stacks 6*a* are engaged and transported by the neighboring reaches of two endless belt conveyors 13 and 14. The gap between the conveyors 13 and 14 is located in or close to the plane of the upper each of the conveyor 8. The stacks 6*a* which are transported by the conveyors 13 and 14 are brought to a halt in a punching or perforating unit 16 which includes suitable means (not specifically shown) for providing the trailing portion of each stack 6*a* with a row of equally spaced holes or perforations 22 (shown in FIG. 2*a*). Each row of perforations 22 extends at right angles to the direction of movement of the stacks 6*a.* Each stack 6*a* which is provided with a row of perforations 22 is engaged and transported by the neighboring reaches of two intermittently driven endless belt conveyors 18 and 19 which deliver successive stacks 6*a* to a collecting or stacking unit 23. The conveyors 18, 19 are provided with aligned stops 17 which extend into the path of movement of an oncoming stack 6*a* and arrest the stack in an optimum position with respect to the perforating unit 16 so that the distance between the row of perforations 22 and the rear end face 21 of each stack 6*a* is the same.

The collecting unit 23 converts several successive perforated stacks 6*a* into a larger stack 6*b* wherein the number of sheets 7 may but need not equal the number of sheets in a stack 6. The number of sheets 7 in each stack 6*b* equals the number of sheets or leaves in a pad 29. The means for withdrawing successive stacks 6*b* from the collecting unit 23 comprises a mobile gripping or transferring device 24 with two sets of jaws which are movable into engagement with the uppermost and lowermost sheets of successive stacks 6*b.* The transferring device 24 can advance successive stacks 6*b* through a distance which suffices to move such stacks into the range of intermittently driven entraining elements or pushers 26 shown in FIGS. 1*b* and 2*b.* Each pusher 26 preferably comprises several aligned teeth or like components which engage spaced-apart portions of the rear end face of the respective stack 6*b.* The pushers 26 are mounted on an endless conveyor belt or chain (not specifically shown) which transports them along an endless path having a horizontal upper portion which is shown in FIGS. 1*b* and 2*b.*

The pushers 26 advance successive stacks 6*b* into the range of a severing unit 27 having three knives 28 which are parallel to the direction of movement of pushers 26 and descend when the stack 6*b* therebelow is idle to thus convert such stack into four aligned note books or pads 29. If desired, the severing unit 27 may comprise two additional knives 28*a* which trim the respective lateral marginal portions of the stack 6*b* at the severing station. The pushers 26 thereupon transport successive groups or sets of four registering pads 29 each to the first station of an intermittently driven rotary conveyor or turret 32 which is indexible about a horizontal axis 35 normal to the direction of movement of pads 29 with the pushers 26. The pushers 26 deliver successive groups of pads 29 into successive holders 38 of the turret 32 at the nine o'clock position of the turret, as viewed in FIG. 1*b*. The respective pushers 26 are thereupon returned in a direction to the left, as viewed in FIG. 1*b*, to engage and entrain freshly assembled stacks 6*b* in the region of the gripping device 24.

Figure 1B:
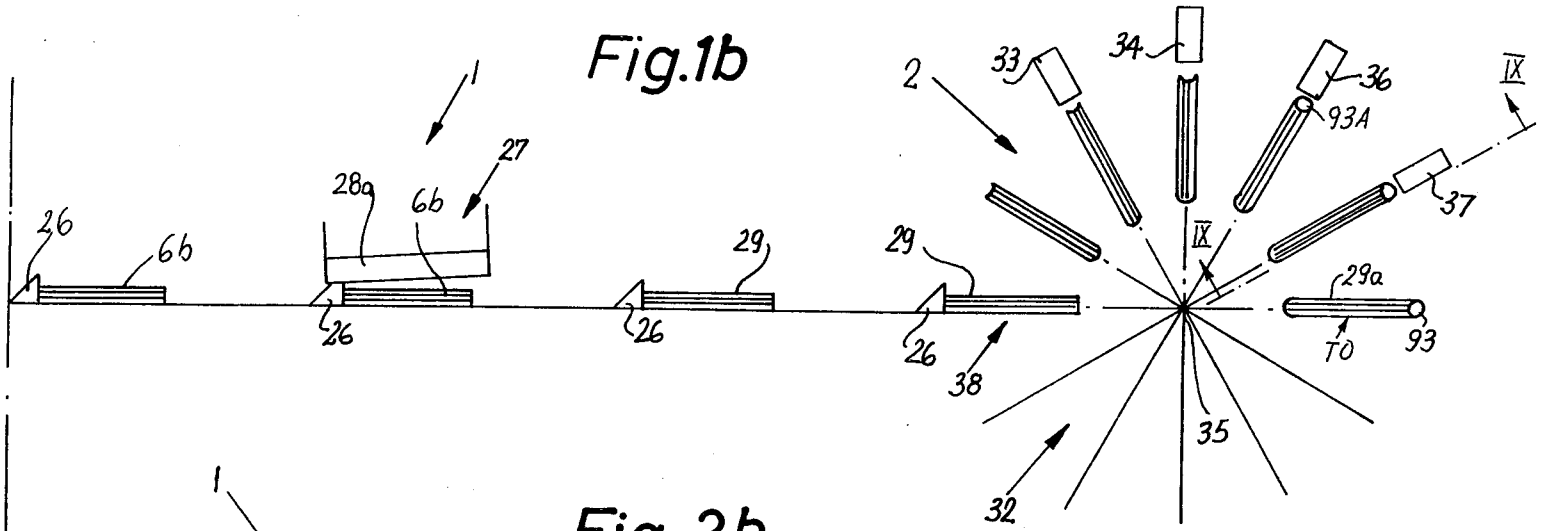
FIG. 1*b* is a schematic side elevational view of a second portion of the apparatus, namely, that portion which includes the improved arrangement.
Figure 2B:
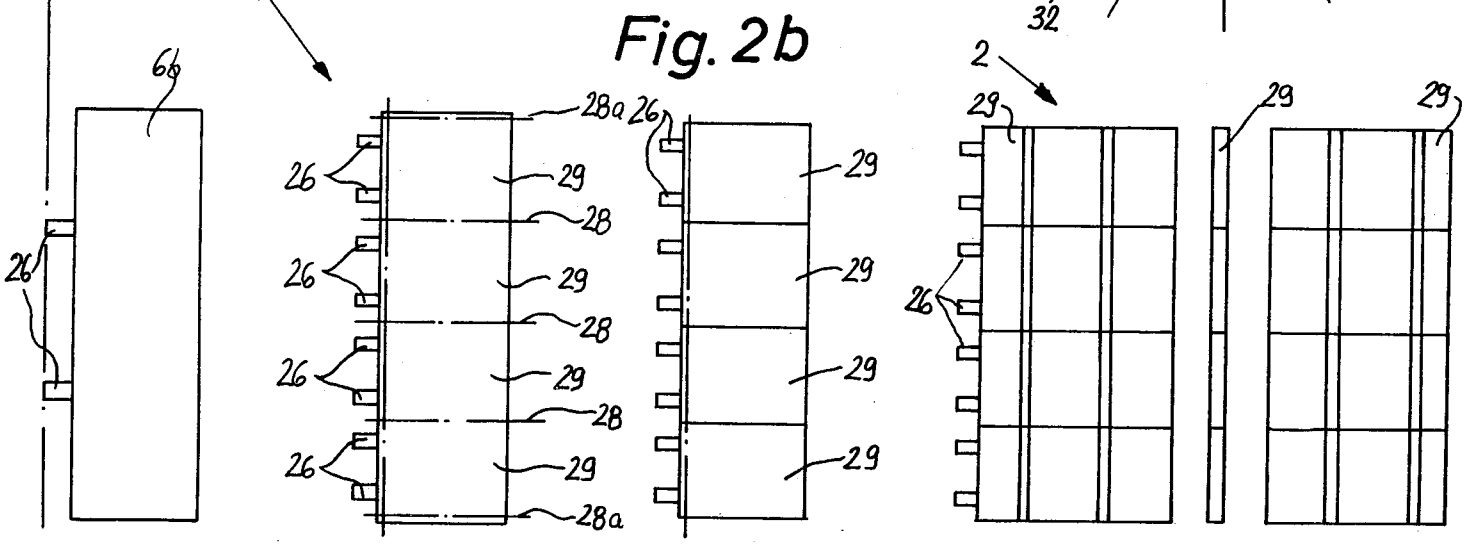
FIG. 2*b* is a schematic plan view of the structure shown in FIG. 1*b;*
Figure 3A:
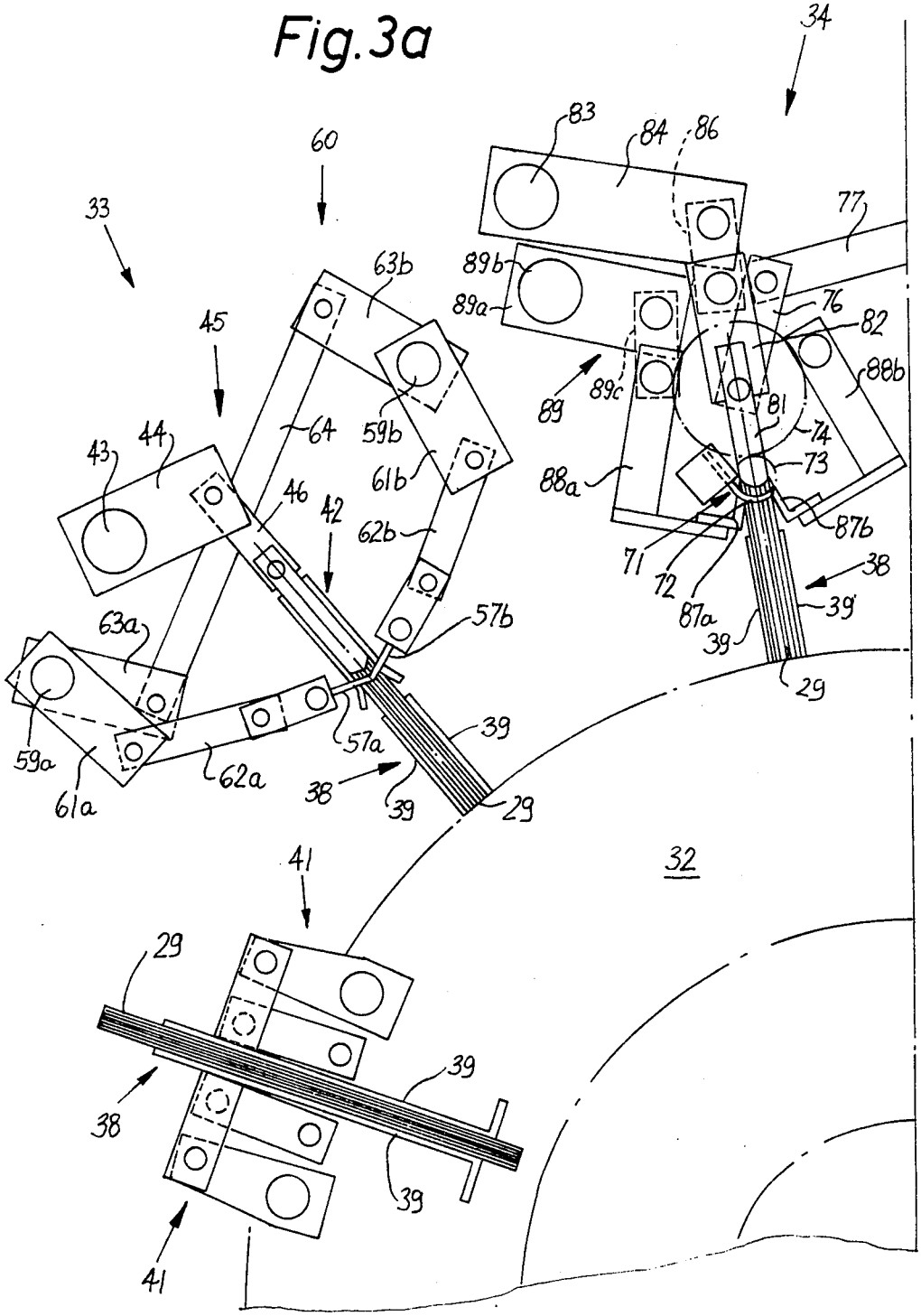
FIG. 3*a* is a schematic end elevational view of the upper left-hand portion of a turret-shaped conveyor forming part of the structure shown in FIG. 1*b* and constituting one component of the improved arrangement, this Figure further showing the two aligning units of the improved arrangement.
Figure 3B:
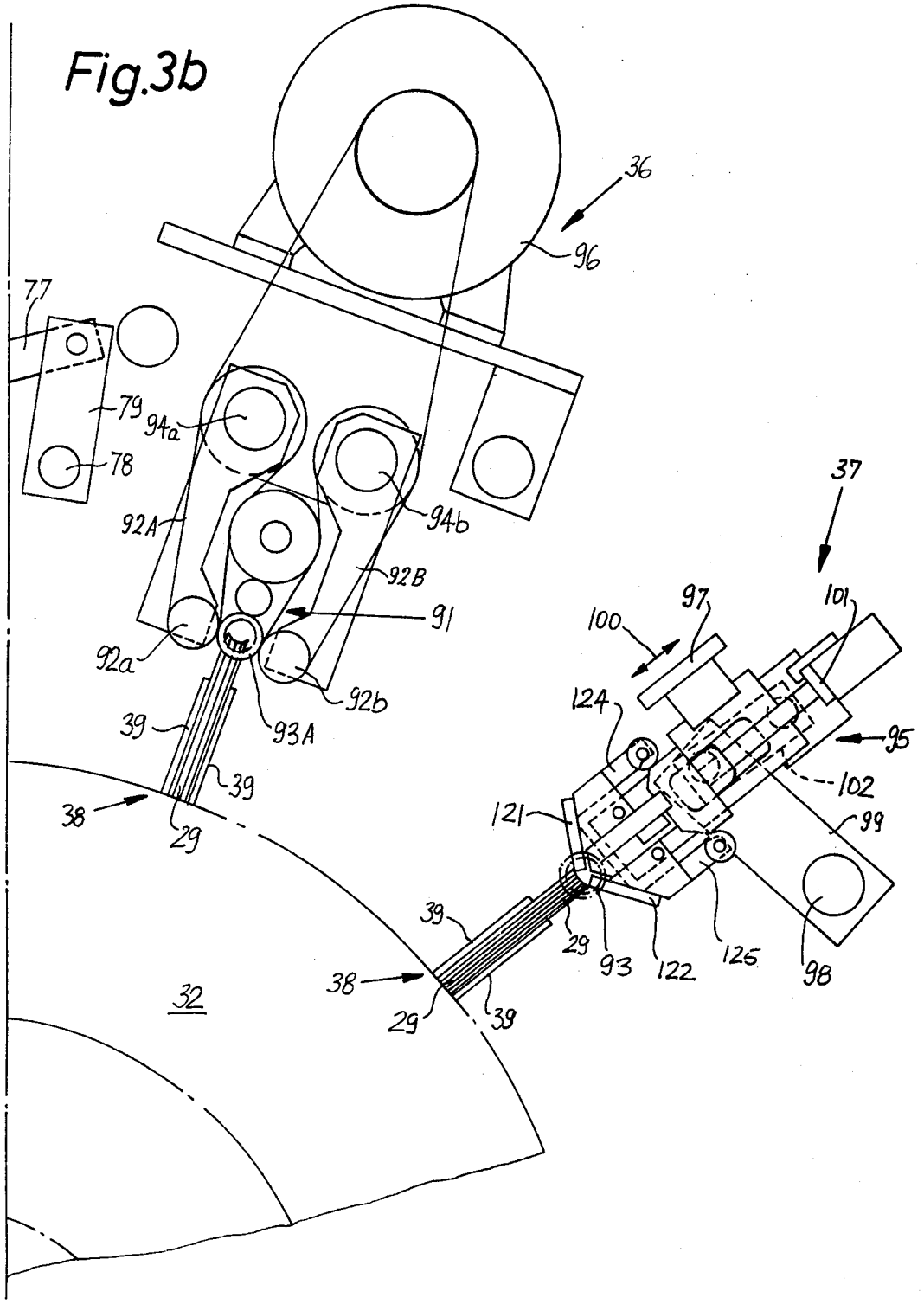
FIG. 3*b* is a schematic end elevational view of the upper right-hand portion of the turret-shaped conveyor in the structure of FIG. 1*b,* further showing a spiral inserting unit and a spiral severing and binder deforming unit.

FIGS. 1*b*, 3*a* and 3*b* show that the turret 32 transports successive groups of pads 29 past a first aligning unit 33 (located at or close to the eleven o'clock position), thereupon past a second aligning unit 34 (located at or close to the twelve o'clock position), past a spiral introducing unit 36 (located at or close to the one o'clock position), past a wire trimming or severing and deforming unit 37 (located at or close to the two o'clock position) and finally to a take-off station TO at which the groups of fully assembled (finished) pads 29*a* (each having a spiral binder 93) are removed from the turret 32 for delivery to storage, to a conveyance or to a further processing station, not shown.

Each holder 38 of the turret 32 defines a chamber which can receive an entire group of four registering pads 29, and each of these holders comprises gripping means consisting of two spaced-apart jaws or claws 39 at least one of which can be moved toward and away from the other jaw by means of a linkage 41 (FIG. 3*a*) receiving motion at predetermined intervals from a cam (not specifically shown) which is preferably mounted on the shaft for the turret 32. When the jaws 39 are moved to their operative positions, they engage and grip the respective outermost sheets of the group of registering pads 29 in the corresponding holder 38 but leave the perforated portions of the pads exposed (see also FIG. 9). The configuration of the aforementioned actuating cam for the linkages 41 of the holders 38 is such that the jaws 39 of each holder 38 move apart at the nine o'clock position of the turret 32 (in order to receive a fresh group of registering pads 29), at the eleven o'clock position (in order to allow for first or preliminary alignment of sheets which constitute the respective group of registering pads 29), at the twelve o'clock position (in order to allow for a second or final alignment or adjustment of sheets which constitute the respective group of registering pads 29), and at the three o'clock position to allow for removal of finished pads 29*a* from the respective holder 38.

FIGS. 4 to 8 illustrate the details of the first aligning unit 33. The unit 33 comprises a substantially U-shaped pattern or jacket 42 which is shiftable radially toward and away from the turret 32 by a mechanism 45 including a stationary guide (not shown) wherein the jacket 42 is movable back and forth. The shifting mechanism 45 further comprises a pivotable lever 44 which is mounted on a fixed shaft 43 and is articulately connected with the jacket 42 by a link 46. The jacket 42 comprises two substantially parallel plates 47 and 48 which define a compartment 49 for the reception of a group of four registering pads 29. The width of the compartment 49 (as considered at right angles to the planes of the major portions of the plates 47 and 48) equals or approximates the thickness of a pad 29. The inner end portions 51, 52 of the plates 47, 48 (i.e., those end portions which are nearer to the turret 32) flare outwardly to insure unimpeded entry of a group of registering pads 29 into the compartment 49 when the jacket 42 is moved toward the axis 35 of the turret 32.

Figure 4:
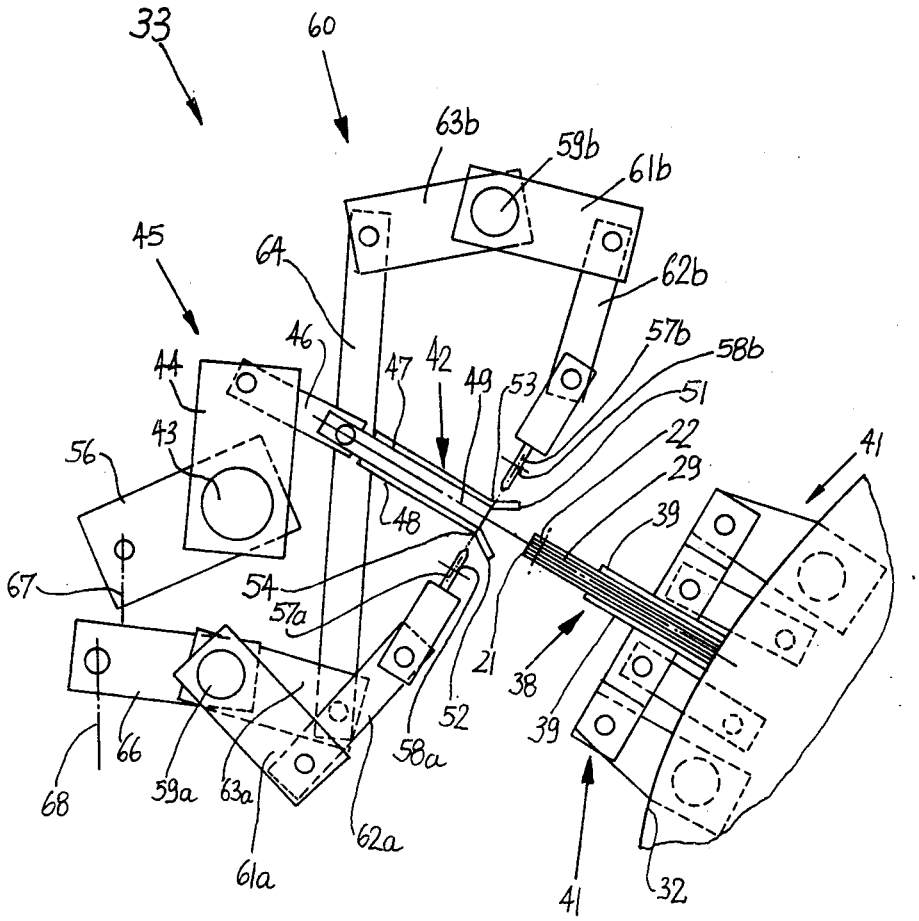
FIG. 4 illustrates the details of the first aligning unit of FIGS. 1*b* and 3*a;*
Figure 5:
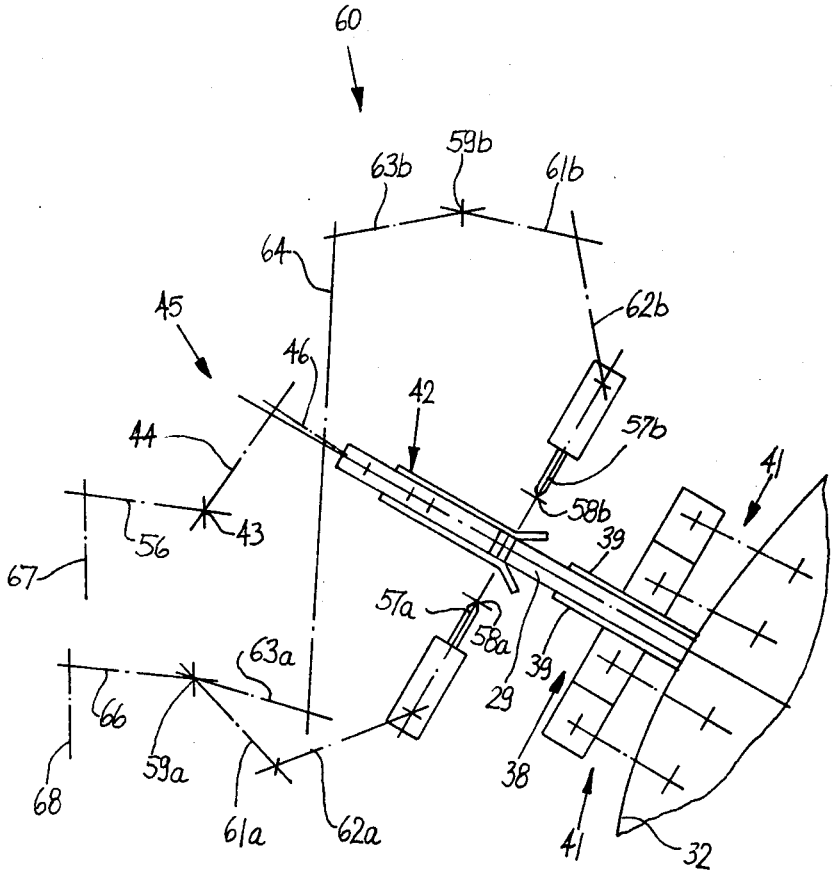
FIG. 5 is a schematic view of the aligning unit of FIG. 4, with the parts of the aligning unit shown in different positions.

The plates 47, 48 are respectively formed with rows of apertures 53, 54 which register with the perforations 22 of a group of pads 29 in the adjacent holder 38 when the jacket 42 is moved from the retracted position of FIG. 4 to the first extended position of FIG. 5. The diameters of apertures 53 and 54 preferably equal or approximate the diameters of perforations 22.

Figure 7:
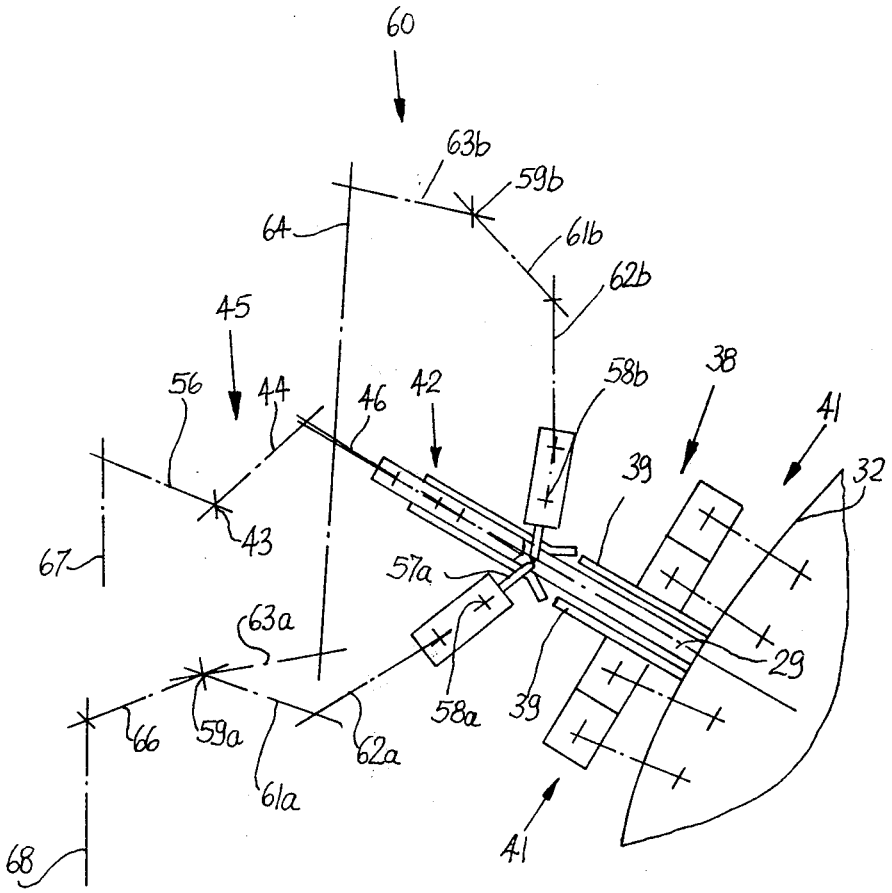
FIG. 7 illustrates the structure of FIG. 6, with the parts shown in different positions.
Figure 8:
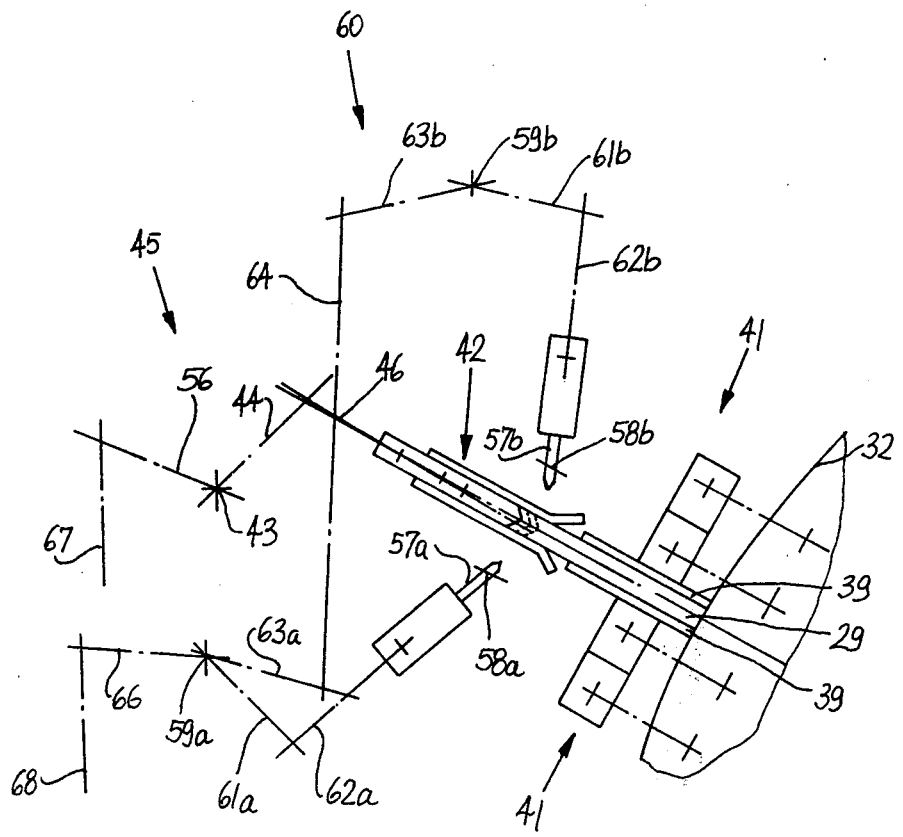
FIG. 8 illustrates the structure of FIG. 7, with the parts shown in different positions.

The means for pivoting the lever 44 of the shifting mechanism 45 back and forth to thereby move the jacket 42 between the positions of FIGS. 4 and 5 and a second extended position which is shown in FIG. 7 comprises a further lever 56 which is mounted on the shaft 43 and is rigid with the lever 44. The lever 56 is pivotable by a suitable drive means (not shown), e.g., by a drive means including a rotary cam.

The jacket 42 is flanked by two rows of pin-shaped mandrels 57*a*, 57*b* which respectively register with the apertures 54, 53 of the plates 48 and 47. The jacket 42 carries suitable guide means (not specifically shown) which confines the mandrels 57*a*, 57*b* to reciprocatory movement toward and away from the respective apertures 54, 53. Furthermore, the mandrels 57*a*, 57*b* are respectively turnable about pivot members 58*a*, 58*b*. These pivot members are or can be mounted in the just mentioned guide means of the jacket 42.

The means 60 for moving the two rows of mandrels 57*a* and 57*b* toward each other comprises levers 61*a*, 61*b* which are respectively mounted on fixed shafts 59*a*, 59*b* and are respectively coupled with the corresponding rows of mandrels by links 62*a*, 62*b*. The levers 61*a*, 61*b* are respectively rigid with levers 63*a*, 63*b* which are coupled to each other by a link 64 to insure that axial movements of mandrels 57*a* are synchronized with the movements of mandrels 57*b*. The levers 61*a*, 63*a* are rigid with a further lever 66 which receives motion from the aforementioned drive means for the lever 56, i.e., from the rotary cam. The cam transmits motion to the levers 56 and 66 by means of connecting rods 67 and 68 which are indicated by phantom lines.

The cam of the drive means for the levers 56 and 66 has three raised portions or lobes to operate the first aligning unit 33 in the following way: The parts of the unit 33 assume the starting or idle positions of FIG. 4 when a holder 38 with a group of registering pads 29 approaches the position shown in FIG. 4. The turret 32 is arrested when the pads 29 in such holder 38 register with the jacket 42 (which is retracted). The aforementioned cam of the drive means for the levers 56 and 66 then causes the jacket 42 to move radially toward the turret 32 so that the apertures 53 and 54 are placed into register with the perforations 22 of the pads 29 at the first aligning station. The aforementioned guide means of the jacket 42 compels the two rows of mandrels 57*a* and 57*b* to share such movement of the jacket; however, the configuration of the cam which transmits motion to the levers 56 and 66 via connecting rods 67 and 68 is such that the angular position of the lever 66 remains unchanged while the jacket moves toward the first extended position of FIG. 5 so that the distance between the mandrels 57*a*, 57*b* and the respective plates 48, 47 of the jacket 42 increases (compare FIGS. 4 and 5). The pivot members 58*a*, 58*b* for the mandrels 57*a* and 57*b* are blocked.

Figure 6:
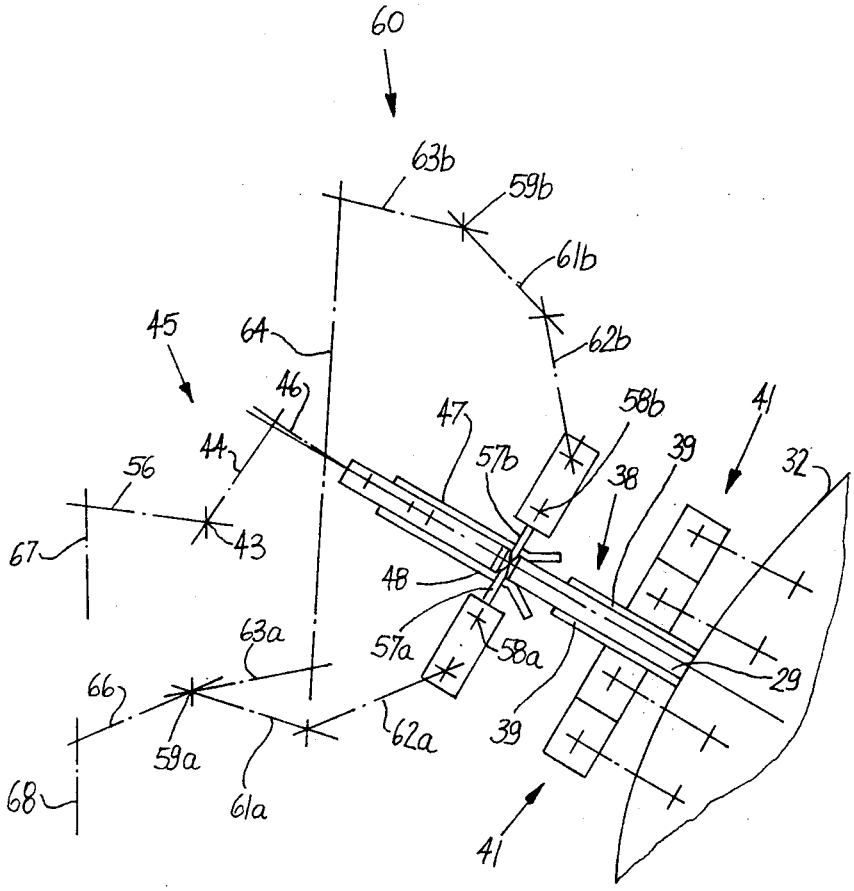
FIG. 6 illustrates the structure of FIG. 5, with the parts shown in other positions.

During the next stage of rotation of the cam which transmits motion to the connecting rods 67 and 68, the jacket 42 remains in the position of FIG. 5 and the connecting rod 68 pivots the lever 66 in a direction to move the two rows of mandrels 57*a* and 57*b* toward each other so that the tips of the mandrels penetrate into the respective perforations 22 of the pads 29 in the compartment 49. The tips of the mandrels 57*a* can acutally engage (abut against) the tips of the aligned mandrels 57*b* (see FIG. 6). The pivot members 58*a*, 58*b* are released when the mandrels 57*a* and 57*b* reach the positions which are shown in FIG. 6. The aforementioned cam for the linkage 41 of the holder 38 at the first aligning station thereupon moves the jaws 39 of such holder away from each other, i.e., the pads 29 which extend into the compartment 49 of the jacket 42 are released by the holder 38 so that their sheets can be moved relative to each other in response to pivoting of the mandrels 57*a* and 57*b* from the positions of FIG. 6 to those shown in FIG. 7. Such pivoting of mandrels 57*a* and 57*b* takes place in response to pivoting of the lever 56 by the connecting rod 67 in a direction to move the jacket 42 toward the turret 32, i.e., to the second extended position. The result is that each straight hole consisting of a series of registering perforations 22 is converted into a substantially V-shaped passage which is shown in FIG. 7. The configuration of each V-shaped passage resembles the curvature of convolutions of a spiral 93A.

The cam on the shaft of the turret 32 thereupon moves the jaws 39 of the holder 38 at the first aligning station (unit 33) toward each other so that the holder 38 engages the pads 29 and maintains the perforations 22 in the positions shown in FIG. 7. The cam for the levers 56 and 66 transmits motion to the connecting rod 68 to withdraw the mandrels 57*a* and 57*b* from the respective perforations 22 as well as from the respective apertures 54 and 53 of the jacket 42 (see FIG. 8), and such cam thereupon causes the rod 67 to pivot the lever 56 in a direction to move the jacket 42 back to the retracted position of FIG. 4. The same procedure is repeated when the next holder 38 advances to the position of register with the jacket 42.

The second aligning unit 34 comprises a comb-like aligning device 71 (hereinafter called comb for short) with a row of hook-shaped prongs 72 whose curvature matches that of the convolutions of a spiral binder 93 (shown in FIGS. 9, 10, 11, 14 and 15), i.e., the radii of curvature of the prongs 72 equal or approximate the radius of a spiral 93A. The comb 71 is rigid with a gear 73 which meshes with a larger gear 74 (both gears are indicated in FIG. 3*a* by phantom lines). The gear 73 can turn back and forth about a fixed axis and the comb 71 shares such movements of the gear 73. The shaft of the gear 74 is fixedly mounted in the frame of the apparatus and the gear 74 is rigidly connected to a lever 76 which, in turn, is articulately connected to a link 77 receiving motion from a lever 79 (see FIG. 3*b*) rotatable about the axis of a fixed shaft 78. The means (e.g., a suitable cam drive) for pivoting the lever 79 back and forth at requisite intervals is not shown in the drawing.

The second aligning unit 34 further comprises a shaping or profiling block 81 which extends along the full length of a group of registering pads 29 at the second aligning station. The profiling block 81 is mounted in or on a carrier 82 which is movable toward and away from the turret 32 by a mechanism including a lever 84 mounted on a fixed shaft 83 and articulately connected to the upper end portion of the carrier 82 by a link 86. The means for pivoting the lever 84 at requisite intervals to move the profiling block 81 into and from engagement with the rear (outer) edge faces of a group of registering pads 29 at the second aligning station may comprise a rotary cam or the like (not shown).

In order to insure that the outer portions of sheets forming the group of registering pads 29 at the second aligning station will be held against spreading apart during foward movement of the profiling block 81, the unit 34 further comprises two elongated pressure plates 87*a* and 87*b* which are mounted at the level of perforations 22 in the group of pads 29 at the second aligning station. The pressure plates 87*a* and 87*b* are respectively mounted on levers 88*a* and 88*b* which can be pivoted back and forth at requisite intervals by a drive 89. This drive comprises a fixed shaft 89*a*, a lever 89*b* on the shaft 89*a*, a link 89*c* which couples the lever 89*b* to the lever 88*a* and suitable means (not shown) for synchronizing the movements of the lever 88*a* with those of the lever 88*b* (however, the levers 88*a* and the 88*b* move in the opposite directions). The synchronizing means is analogous to the parts 63*a*, 63*b*, 64 in the first aligning unit 33. The pressure plates 87*a* and 87*b* have suitable slots, notches, holes or other types of openings for the prongs 72 of the cam 71.

When the turret 32 is in motion, the comb 71 is retracted (to a position to the left of that shown in FIG. 3*a*), the profiling block 81 is also retracted (to a position radially outwardly of and remove from the turret 32), and the levers 88*a* and 88*b* are held in the retracted positions so that the mobile parts of the second aligning unit 34 cannot interfere with indexing of the turret 32 and its holders 38. When a holder 38 reaches the second aligning station (such holder maintains the pads 29 in the positions shown in FIG. 8), the respective linkages 41 cause the jaws 39 to move apart so that the prongs 72 of the comb 71 can deform each V-shaped passage (each such passage consists of a series of registering perforations 22) in a manner as shown in FIG. 3*a*, i.e., the V-shaped passages are converted into arcuate passages whose curvature equals or closely approximates that of the convolutions of a spiral binder 93. It is preferred to relax the pressure upon the outer sides of the outermost sheets of pads 29 at the second aligning station subsequent to entry of prongs 72 into the respective V-shaped passages. The pressure plates 87*a* and 87*b* are moved close to or into contact with the rear or outer edge portions of the outermost sheets of pads 29 at the second aligning station not later than when the profiling block 81 moves inwardly toward the axis 35 of the turret 32 to impart to the rear or outer edge faces of the pads a concave (semicylindrical) profile. The curvature of the inner end face of the profiling block 81 equals or approximates the curvature of prongs 72 and hence the curvature of a binder 93.

It is also possible to employ a stationary profiling block 81 and to provide means for moving the holder 38 at the second aligning station radially outwardly toward the block 81. All that counts is to provide means for effecting a relative movement between the inserted prongs 72 and the sheets of the pads 29 at the second aligning station so as to convert each V-shaped passage into an arcuate passage.

An advantage of the arrangement including the aligning units 33, 34 and the turret 32 with its holders 38 is that the sheets of the pads 29 can be formed with relatively small perforations 22. This is due to the fact that the first aligning unit 33 converts each substantially straight hole (consisting of a series of registering perforations 22) into a V-shaped passage whose configuration approximates or resembles that of an arcuate prong 72. Therefore, the prongs 72 at the second aligning station can be readily inserted into the respective V-shaped passages even if the diameters of perforations 22 are relatively small.

Furthermore, multi-stage conversion of each substantially straight hole into an arcuate passage whose configuration is best suited to receive a portion of a convolution forming part of a spiral 93A is especially desirable when the pads are relatively thick, either because they comprise a large number of leaves or because the leaves are rather thick. It can be said that the first stage involves a coarse alignment which results in conversion of straight holes into passages suited for insertion of arcuate prongs, and that the second stage involves a final or high-precision adjustment which insures that the leader of the spiral 93A does not become stuck during threading of the spiral into a group of registering pads at the station for the spiral inserting unit 36.

The jacket 42 of the first aligning unit 33 performs several useful functions, namely, it supports and moves the two rows of mandrels 57*a*, 57*b* toward and from positions of register with the respective holes of pads 29 at the first aligning station, its apertures 53 and 54 guide the tips of mandrels 57*a*, 57*b* into the respective straight holes from opposite sides of pads 29 at the first aligning station, its compartment 49 prevents undue spreading of leaves of the pads 29 when the jaws 39 of the holder 38 at the first aligning station are moved apart to relax the pressure upon the unperforated portions of outermost leaves of the pads, and it pivots the mandrels during movement from the extended position of FIGS. 5 and 6 to the second extended position of FIG. 7 whereby the mandrels convert each straight hole into a V-shaped passage.

The spiral introducing unit 36 includes a conventional coiling device 91 which converts straight metallic or plastic wire into a spiral 93A. The coiling device 91 is adjacent to the outer edge faces of pads 29 which reach the spiral inserting station (see FIG. 3*b*). The unit 36 further comprises two abutments 92*a*, 92*b* which flank the path of movement of the leader of a spiral 93A into and out of successive sets of perforations 22 (the spiral 93A rotates about its own axis which is normal to the plane of FIG. 3*b*); these abutments extend along the full length of a group of registering pads 29 at the spiral inserting station and are preferably provided with suitable notches, recesses or analogous guide means for the helices of the spiral 93A. The abutments 92*a*, 92*b* are mounted at the free ends of two levers 92A, 92B which are pivotable about the axes of fixed shafts 94*a*, 94*b* so that they can be moved out of the way when a group of registering pads 29 advances toward or away from the spiral inserting station. The means for pivoting the levers 92A and 92B is similar with or analogous to the parts 63*a*, 63*b*, 64 of the first aligning unit 33.

The coiling device 91 of the spiral inserting unit 36 is preferably driven by a discrete prime mover 96, e.g., a variable-speed electric motor. The mode of operation of the spiral inserting device 36 is known in the art; therefore, a detailed description of the manner in which the spiral 93A is formed and threaded into the pads 29 at the station for the unit 36 is not necessary.

Figure 9:
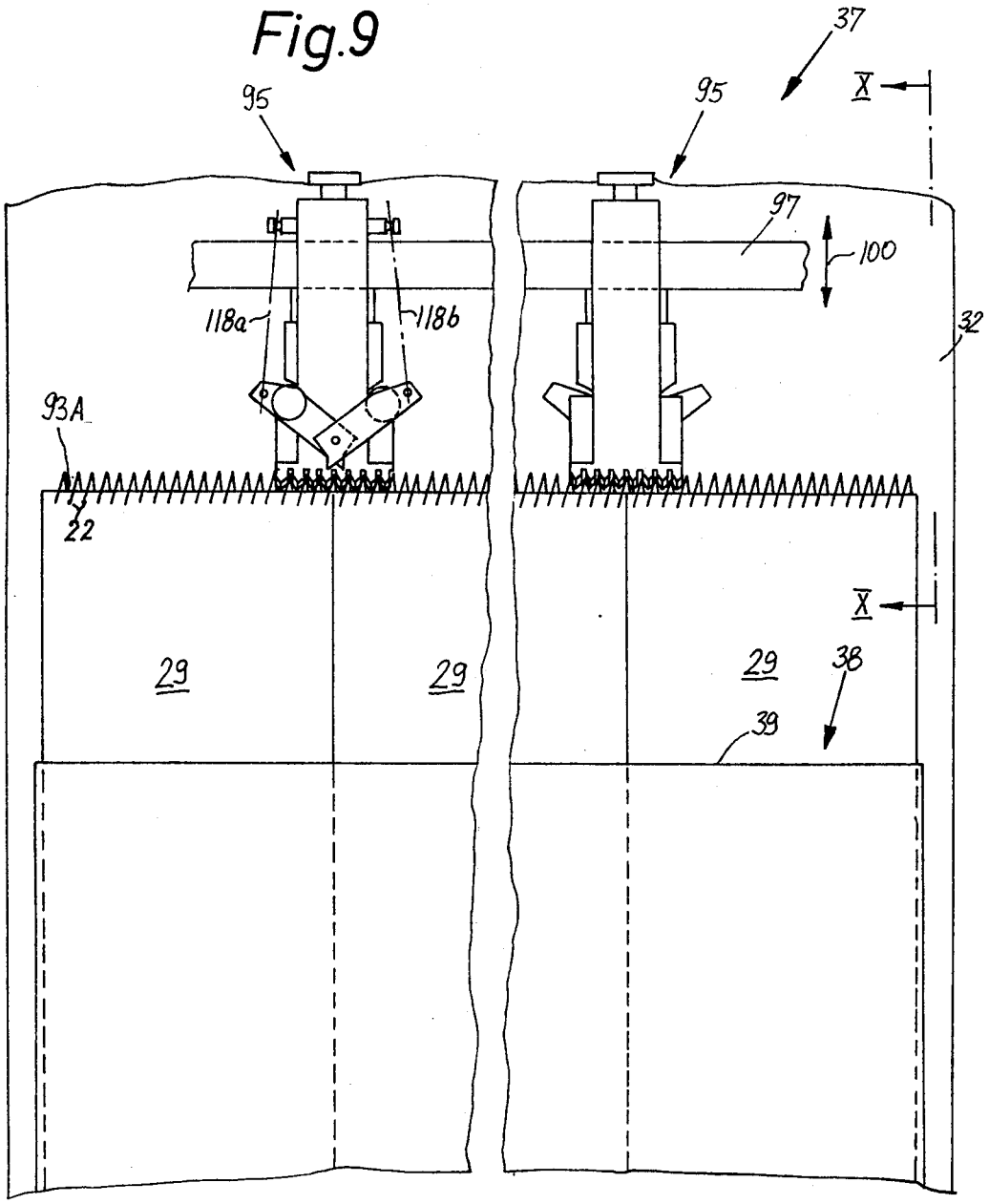
FIG. 9 is an enlarged fragmentary view as seen in the direction of arrows from the line IX—IX of FIG. 1*b;*

The construction of the trimming or severing and deforming unit 37 is shown in detail in FIGS. 9 to 13. FIG. 9 merely shows two of the three trimming or severing and deforming devices or tools 95 which are provided to sever and deform a spiral 93A at the trimming station in order to convert such spiral into four discrete binders 93. The unit 37 further comprises two additional trimming devices or tools (not shown) which merely bend or bend and loop the free ends of the spiral 93A at the trimming station. The construction of such additional trimming tools is similar to but simpler than that of the tools 95 because each additional tool must trim (if necessary) and bend or bend and loop only one end portion of that length of wire which forms a spiral 93A.

The trimming devices or tools 95 are mounted on a common supportig bar 97 which is movable in directions indicated by a double-headed arrow 100, i.e., toward and away from a spiral 93A at the trimming station. An elongated adjusting or displacing member 101 is provided to impart movements to mobile parts of the trimming tools 95 so that the tools can sever the spiral 93A and bend the end portions (namely, portions of the outermost convolutions) of the resulting binders 93. The displacing member 101 receives motion from a lever 99 (see FIG. 3*b*) mounted on a fixed shaft 98 and articulately connected to the member 101 by one or more links 102.

Figure 10:
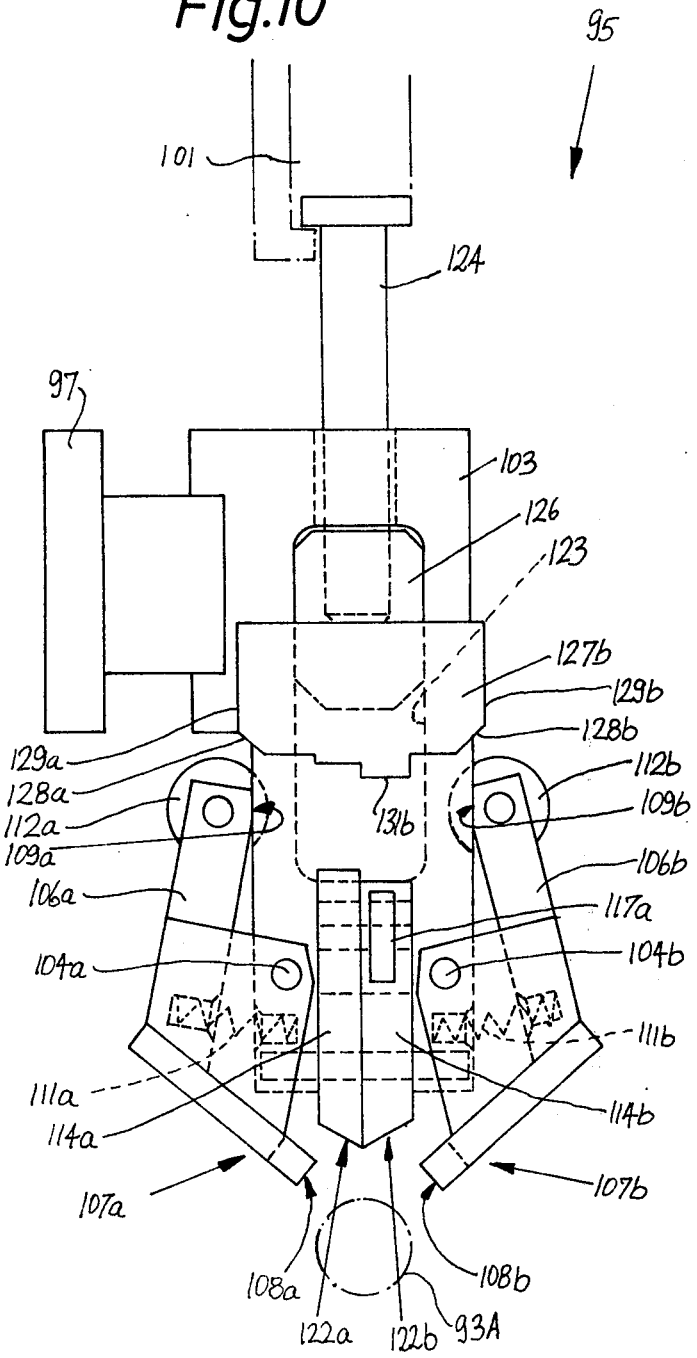
FIG. 10 is an enlarged view as seen in the direction of arrows from the line X—X of FIG. 9, with the note books omitted.

Each trimming device or tool 95 comprises a carriage or support 103 which is secured to the supporting bar 97 and includes two pivot members or shafts 104*a*, 104*b* for bell crank levers 106*a*, 106*b*. The levers 106*a*, 106*b* constitute a means for positioning or locating the convolutions of the spiral 93A by means of spaces 110 between their teeth 108*a*, 108*b*. These teeth are provided at the free ends of lower arms or jaws 107*a*, 107*b* of the respective bell crank levers. The inclination and distribution of the tooth spaces 110 correspond to the distance between and the lead of helices of the spiral 93A. The upper arms of the bell crank levers 106*a*, 106*b* have facetted portions 109*a*, 109*b* which normally abut against the carriage 103. The levers 106*a*, 106*b* are respectively biased by helical springs 111*a*, 111*b* which react against the carriage 103 and tend to maintain the facetted portions 109*a*, 109*b* in abutment with the respective side faces of the carriage. The idle positions of the bell crank levers 106*a* and 106*b* are shown in FIG. 10. It will be noted that the toothed lower arms 107*a*, 107*b* are spaced apart from the convolutions of the spiral 93A. The upper arms of the levers 106*a*, 106*b* respectively carry roller followers 112*a*, 112*b*.

The axes of the shafts 104*a*, 104*b* for the bell crank levers 106*a*, 106*b* are parallel to the axis of the spiral 93A at the trimming station. The carriage 103 further includes or supports a pivot member or shaft 113 whose axis is normal to and crosses in space with the axis of the spiral 93A. The shaft 113 supports two levers 114*a*, 114*b* which constitute the sections or halves of a cutting implement or shears for the wire of the spiral 93A. The cutting edges 116*a*, 116*b* of the sections or levers 114*a*, 114*b* sever the wire when the levers are pivoted toward each other from the positions of FIG. 12 to those shown in FIG. 13. The cutting edges 116*a*, 116*b* are provided on the shorter lower arms of the levers 114*a*, 114*b*; the longer upper arms of these levers carry roller followers 117*a*, 117*b*. Furthermore, the free ends of the upper arms of the levers 114*a*, 114*b* are connected to helical springs 118*a*, 118*b* (shown in FIGS. 9, 12 and 13) whose upper ends are attached to posts 119*a*, 119*b* of the carriage 103. The springs 118*a*, 118*b* tend to move the cutting edges 116*a*, 116*b* on the lower arms of the levers 114*a*, 114*b* away from each other.

Figure 12:
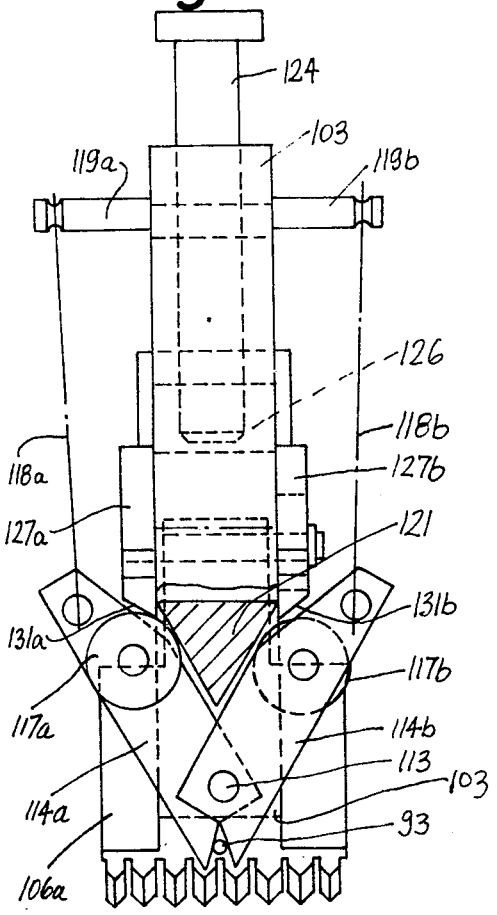
FIG. 12 is an enlarged view of one of the spiral severing units in FIG. 9.
Figure 13:
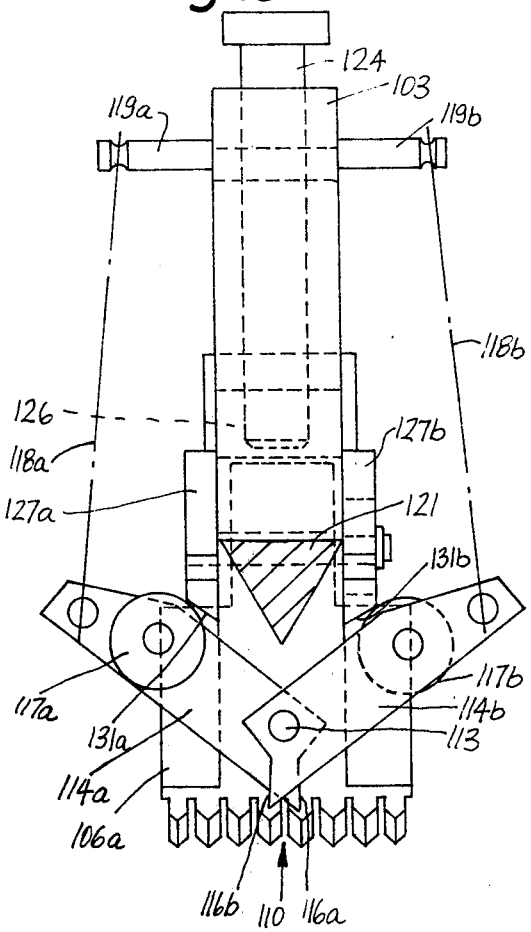
FIG. 13 illustrates the structure of FIG. 12, with the parts shown in different positions.

When the levers 114*a*, 114*b* dwell in the inoperative positions of FIG. 12, their roller followers 117*a*, 117*b* abut against the respective inclined faces of a wedge-like auxiliary cam 121 which is secured to or forms part of the carriage 103. That portion of the carriage 103 which supports or includes the auxiliary cam 121 is bifurcated. The cutting edges 116*a*, 116*b* assume positions in which the wire of the spiral 93A can be moved therebetween preparatory to severing.

In addition to performing a severing operation, the lower arms of the sections or levers 114*a*, 114*b* further serve to deform or bend the free end portions of the adjacent binders 93 which are obtained on severing of the spiral 93A. To this end, the lower arms of the levers 114*a*, 114*b* are respectively provided with wire deforming portions or shoulders 122*a*, 122*b* which are adjacent to the respective cutting edges 116*a*, 116*b*. When the toothed jaws 107*a*, 107*b* of the bell crank levers 106*a*, 106*b* are closed to engage the adjacent convolutions of the spiral 93A, the deforming portions 122*a*, 122*b* are parallel to the respective jaws (see FIG. 11).

The carriage 103 further includes guide means or ways 123 for a reciprocable slide 126 which is connected to the displacing member 101 by means of a plunger or rod 124. The displacing member 101 can move the slide 126 toward or away from the spiral 93A at the trimming station. The slide 126 has suitably configurated cams 127*a* and 127*b* for the roller followers 112*a*, 112*b* of the bell crank levers 106*a*, 106*b*. The cams 127*a*, 127*b* respectively include inclined first cam faces 128*a*, 128*b* and second cam faces 129*a*, 129*b* which are parallel to each other and adjacent to the respective first cam faces. In addition, the cams 127*a* and 127*b* comprise cam faces 131*a* and 131*b* for the roller followers 117*a*, 117*b* of the levers 114*a*, 114*b*. The slide 126, its cams 127*a*, 127*b* and the rod 124 can be said to constitute a means for moving the toothed jaws 107*a*, 107*b* into engagement with the convolutions of the spiral 93A as well as for moving the cutting edges 116*a*, 116*b* (and hence also the shoulders 122*a*, 122*b*) toward each other. The jaws 107*a*, 107*b* move apart under the action of the springs 111*a*, 111*b*, and the lower arms of the levers 114*a*, 114*b* move apart under the bias of the springs 118*a*, 118*b*.

An important advantage of the improved tools 95 is that they can sever and deform the material of successive spirals 93A between pairs of immediately adjacent pads 29, i.e., it is not necessary to move the pads away from each other prior to introduction of a spiral in order to provide room for movement of tools 95 to their operative positions in which the cutting edges 116*a*, 116*b* can sever the wire and the shoulders 122*a*, 122*b* can deform the thus obtained end portions 93B while the convolutions at both sides of the severing plane are engaged by the toothed portions 107*a*, 107*b* of the levers 106*a*, 106*b*. In other words, each tool 95 can replace two conventional tools which are used to sever a spiral at two spaced-apart points between two registering pads which have been moved apart for the express purpose of enabling the conventional tools to perform the severing operations. Moreover, and as mentioned above, each tool 95 can sever a spiral 93A without any waste in the material of the spiral.

Figure 11:
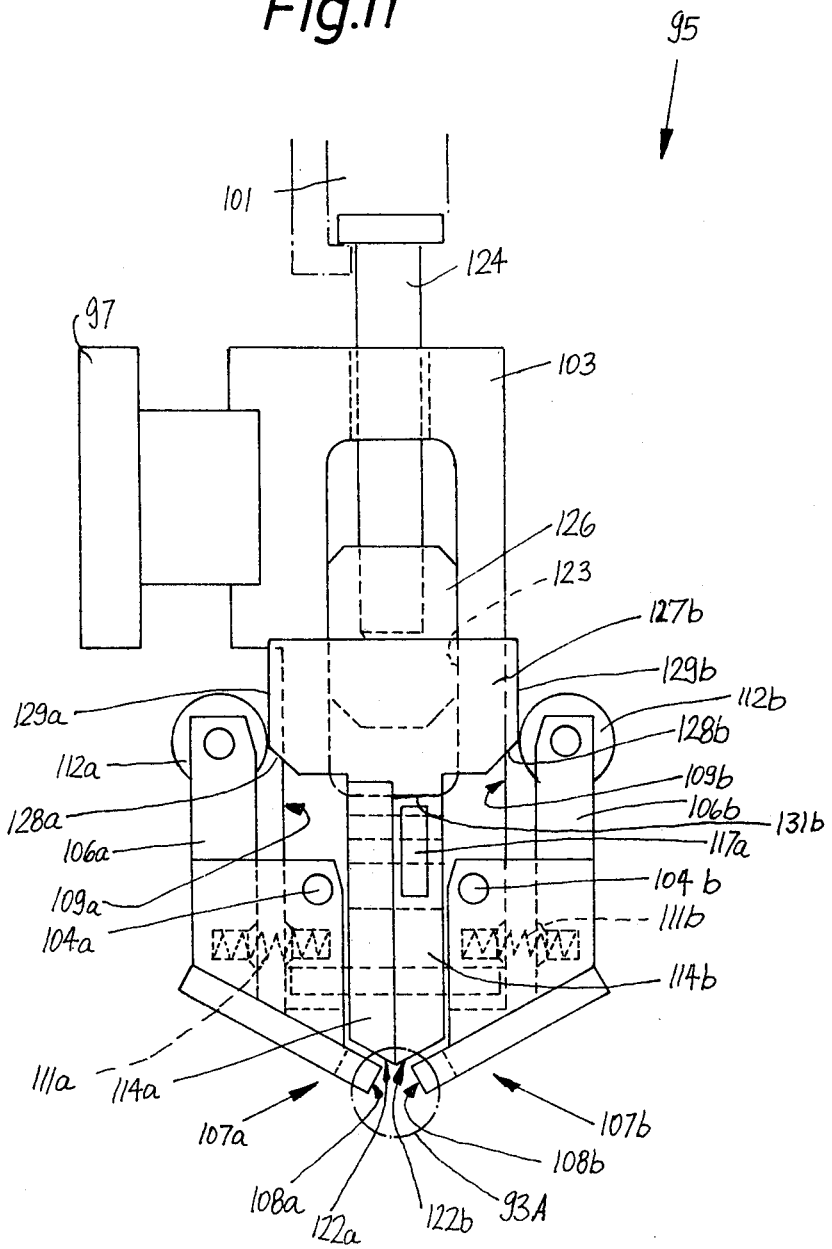
FIG. 11 illustrates the structure of FIG. 10, with the parts shown in different positions.

The operation of the trimming or severing and deforming device or tool 95 which is shown in FIGS. 10 to 13 is as follows:

FIG. 10 illustrates the parts of the tool 95 in their starting or idle positions. Thus, the toothed jaws 107*a*, 107*b* of the bell crank levers 106*a*, 106*b* and the lower arms of the sections or levers 114*a*, 114*b* are remote from the spiral 93A. The supporting bar 97 thereupon moves the support or carriage 103 toward the spiral 93A so that a portion of the spiral extends between the cutting edges 116*a*, 116*b* when the carriage 103 reaches its inner end position which is shown in FIG. 11. The cutting edges 116*a*, 116*b* thereby perform at least some centering action upon the adjacent portion of the spiral 93A. In the next step, the displacing member 101 is moved toward the turret 32 to move the slide 126 along the ways 123 through the medium of the plunger 124. The faces 128*a*, 128*b* of the cams 127*a*, 127*b* cause the roller followers 112*a*, 112*b* to pivot the bell crank levers 106*a*, 106*b* against the opposition of the respective springs 111*a*, 111*b* whereby the toothed jaws 107*a*, 107*b* move toward the spiral 93A and the tooth spaces 110 receive portions of the adjacent convolutions. This insures that the spiral 93A is properly located for the severing and deforming operations which follow. The jaws 107*a*, 107*b* thereupon remain in their operative positions (in which the convolutions of the spiral 93A extend into the tooth spaces 110) because the roller followers 112*a*, 112*b* begin to track the parallel cam faces 129*a*, 129*b* of the moving cams 127*a*, 127*b*.

Figure 14:
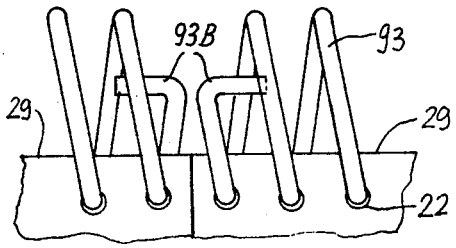
FIG. 14 is an enlarged fragmentary side elevational view of two neighboring note books whose sheets or leaves are held together by discrete spiral binders.
Figure 15:
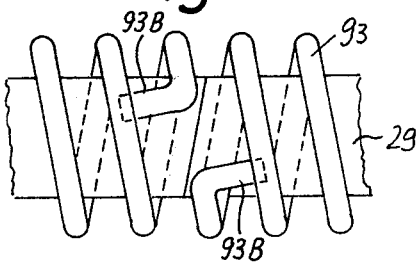
FIG. 15 is a plan view of the note books of FIG. 14.

As the slide 126 continues to move toward the axis 35 of the turret 32, the faces 131*a*, 131*b* of the cams 127*a*, 127*b* reach and displace the roller followers 117*a*, 117*b* of the levers 114*a*, 114*b* whereby the cutting edges 116*a*, 116*b* move toward each other and sever the wire of the spiral 93A. The downward or inward movement of the slide 126 continues, i.e., the levers 114*a*, 114*b* continue to pivot whereby their shoulders 122*a*, 122*b* deform the adjacent end portions of the resulting binders 93. As shown in FIGS. 14 and 15, the end portions 93B of the binders 93 are bent toward each other in such a way that they extend in parallelism or substantial parallelism with the axes of the respective binders. In deforming the end portions 93B, the shoulders 122*a*, 122*b* cooperate with the teeth 108*a*, 108*b* of the respective jaws 107*a*, 107*b*.

The displacing member 101 thereupon moves the slide 126 away from the turret 32, and such movement of the displacing member 101 is followed by upward movement of the supporting bar 97 to return all parts of the tool 95 to the positions shown in FIG. 10. This enables the turret 32 to perform an angular movement in a direction to place the next group of registering pads 29 (with a spiral 93A) into requisite position with respect to the tools 95. The finished pads 29*a* are transported to the take-off station TO for detachment from the respective holder 38 and for transport to storage, to a conveyance or to a further processing station.

The just described method and apparatus exhibit a number of important advantages over the aforediscussed conventional automatic and semiautomatic methods and apparatus. Thus, all units of the apparatus can be disposed in a single line, one behind the other, as considered in the direction of transport of sheets 7 and pads 29, because the path along which the sheets and pads move is bounded by two parallel planes (these planes are indicated in FIG. 2*a* by the phantom lines X—X and Y—Y). Moreover, and since the perforating unit 16 extends transversely of the direction of movement of stacks 6*a* along the planar first section 1 of the path (in the illustrated embodiment, the first section 1 is located in a horizontal plane), the step of perforating the sheets 7 of successive stacks 6*a* takes up a very short interval of time regardless of the length of the sheets 7, i.e., regardless of whether each sheet 7 is dimensioned to yield two, three, four, five, six or more leaves of a pad 29. The length of each step which is performed by the stacks 6, 6*a*, 6*b* and groups of registering pads 29 need not exceed the length of steps which must be performed in conventional apparatus which are designed to produce a single file of pads.

The improved method and apparatus are more economical than the aforediscussed conventional methods and apparatus because the material of the metallic or plastic wire which is used for the making of spirals 93A can be processed without any or with negligible waste. This is due to the fact that the pads 29 of each group at the station for the spiral introducing unit 36 are immediately adjacent to each other, i.e., the spiral 93A is merely severed in regions between neighboring pads 29 of a group and such severing does not or need not entail any waste in the material of the spiral.

The provision of transporting means which includes at least one indexible turret is advantageous because this reduces the overall length of the apparatus, i.e., the overall length of the path along which the constituents of finished pads 29*a* travel from the feeding station 3 to the take-off station TO. The bending of end portions 93B of discrete binders 93 is desirable and advantageous because such deformation of the end portions insures that the end convolutions are not likely to leave the perforations of the respective pads 29*a*. As mentioned above, the end portions 93B are preferably deformed in such a way that they extend in parallelism with the axes of the respective binders 93 and that their tips face each other. In addition, the bending of end portions 93B reduces the likelihood of injury to the hands of persons using the pads 29*a*, to personnel in the manufacturing plant and/or to workmen in charge of stacking, storing, transporting and/or distributing the pads.

The feature that the second section 2 of the path is defined by an indexible conveyor is desirable and advantageous on the additional ground that the aligning units 33, 34, the spiral inserting unit 36 and the severing and deforming unit 37 can be fixedly mounted adjacent to the path of movement of holders 38.

The various mechanisms and drives for imparting movements to transporting means as well as to the mobile components of various units can be of conventional design. Furthermore, the apparatus can be equipped with suitable means for monitoring the movements of components of the pads 29*a* and for producing signals in response to detection of eventual malfunctions. The exact construction of the drives and monitoring means froms no part of the present invention.

The apparatus of the present invention can embody means for moving the registering pads of successive groups apart, e.g., for the purpose of enabling suitable tools to provide the pads with rounded corners or for other purposes. In other words, the sheets 7 and the pads 29 are confined to movement along the aforementioned path between the planes X—X and Y—Y while they undergo those treatments which were described above, namely, assembly of stacks 6, conversion of stacks 6 into stacks 6*a*, perforation of stacks 6*a*, conversion of stacks 6*a* into stacks 6*b*, alignment of perforations 22 in successive groups of registering pads 29, introduction of spirals 93A into successive groups of registering pads 29, severing or trimming of spirals 93A and, if desired, bending of end portions 93B of the thus obtained binders 93.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the claims.

What is claimed is:

1. A method changing the configuration of a plurality of elongated holes each of which consists of registering perforations provided in one marginal portion of each sheet of a pile of sheets which are about to receive a spiral having a predetermined radius and serving to hold the sheets of the pile together, comprising the steps of simultaneously converting all holes into substantially V-shaped passages disposed in planes which are at least nearly normal to the planes of the sheets and to the one marginal portion of each sheet, including introducing into each hole a pair of mandrels from opposite sides of the pile and pivoting at least one mandrel of each pair with respect to the other mandrel of the respective pair; and simultaneously converting all V-shaped passages into arcuate passages having radii of curvature which at least approximate said predetermined radius.

2. A method as defined in claim 1, wherein said last mentioned converting step comprises inserting arcuate prongs into said V-shaped passages and effecting a relative movement between the sheets of the pile and the inserted prongs so that all sheets abut against the prongs.

3. A method as defined in claim 1, wherein each sheet of said pile is a composite sheet consisting of at least two immediately adjacent leaves.

4. An arrangement for changing the configuration of a plurality of elongated holes consisting of registering perforations provided in one marginal portion of each sheet of a pile of sheets which are about to receive a spiral having a predetermined radius and serving to hold the sheets of the pile together, comprising a holder having means for gripping the outermost sheets of the pile while leaving the holes exposed; means for moving said holder from a first to a second station; a first aligning unit disposed at said first station and including two rows of mandrels located at the opposite sides of the pile at said first station, and means for imparting to said mandrels a composite movement including introducing each mandrel into a discrete hole from the respective side of the pile at said first station and pivoting at least one row of mandrels with respect to the other row of mandrels to thereby convert each hole into a substantially V-shaped passage disposed in a plane which is at least nearly normal to the planes of the sheets and to the one marginal portion of each sheet in said holder; and a second aligning unit disposed at said second station and comprising a plurality of arcuate prongs, one for each V-shaped passage of the pile at said second station, the radii of curvature of said prongs at least approximating said predetermined radius, means for inserting said prongs into the V-shaped passages of the pile at said second station, and means for effecting a relative movement between the inserted prongs and the sheets of the pile at said second station to thereby convert said V-shaped passages into arcuate passages having a curvature at least approximating the curvature of said prongs.

5. An arrangement as defined in claim 4, wherein said means for moving said holder comprises a conveyor which is movable stepwise to transport said holder from said first to said second station.

6. An arrangement as defined in claim 4, wherein said means for imparting to said mandrels said composite movement includes a jacket defining a compartment for reception of perforated portion of the pile at said first station and means for moving said jacket relative to the holder at said first station between at least one extended position in which the perforated portion of the pile at said first station extends into said compartment and a retracted position, said jacket having apertures through which said mandrels pass while extending into the respective holes of the pile at said first station and said mandrels being pivoted by said jacket while the latter moves relative to the holder at said first station.

7. An arrangement as defined in claim 6, wherein said means for moving said jacket includes means for shifting said jacket between three positions including said retracted position, said one extended position and a second extended position whereby said jacket pivots said mandrels during shifting from said one to said second extended position.

8. An arrangement as defined in claim 4, wherein said means for moving said holder includes an indexible turret, said gripping means including two jaws defining a chamber for the unperforated portion of the pile and further comprising means for moving at least one of said jaws relative to the other jaw at each of said stations so as to relax the pressure of said jaws upon the adjacent sheets of the pile in said holder during conversion of holes into V-shaped passages and again during conversion of V-shaped passages into arcuate passages.

9. An arrangement as defined in claim 4, wherein said pile consists of a group of registering note books and said gripping means includes jaws arranged to simultaneously engage the outermost sheets of the entire group of note books.

* * * * *